US009664473B2

(12) United States Patent
Poehlman et al.

(10) Patent No.: US 9,664,473 B2
(45) Date of Patent: May 30, 2017

(54) HANDLE FOR MANIPULATING FIREARM ROD

(71) Applicant: Battenfeld Technologies, Inc., Columbia, MO (US)

(72) Inventors: Michael Poehlman, Columbia, MO (US); James Tayon, Moberly, MO (US); Dennis W. Cauley, Jr., Booneville, MO (US); Michael Cottrell, Columbia, MO (US); Tim Kinney, Columbia, MO (US); Matthew Kinamore, Columbia, MO (US); James Gianladis, Harrisburg, MO (US); Adam J. Birk, Hallsville, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 0 days.

(21) Appl. No.: 14/994,798

(22) Filed: Jan. 13, 2016

(65) Prior Publication Data

US 2016/0202015 A1 Jul. 14, 2016

Related U.S. Application Data

(60) Provisional application No. 62/103,441, filed on Jan. 14, 2015.

(51) Int. Cl.
*F41A 35/00* (2006.01)
*F41A 29/02* (2006.01)

(52) U.S. Cl.
CPC ..... *F41A 35/00* (2013.01); *F41A 29/02* (2013.01)

(58) Field of Classification Search
CPC ..... F41C 9/085; F41A 29/00; F41A 35/00; F41A 99/00; B25F 1/02; B25F 1/04; B25G 3/20; B25G 3/22; B25G 3/24
USPC ..... 42/51, 90, 95; 81/491
See application file for complete search history.

(56) References Cited

U.S. PATENT DOCUMENTS

| | | | | | |
|---|---|---|---|---|---|
| 1,435,647 | A * | 11/1922 | McCanna | F41A 29/02 | 15/104.18 |
| 4,803,792 | A * | 2/1989 | Brown, Jr. | F41A 29/02 | 15/104.05 |
| 4,866,871 | A * | 9/1989 | Rivers | F41A 29/02 | 15/104.16 |
| 5,075,998 | A | 12/1991 | Selleck | | |
| 5,233,124 | A * | 8/1993 | Peterson | F42B 35/02 | 33/506 |
| 5,357,705 | A | 10/1994 | Stengel | | |
| 5,588,242 | A | 12/1996 | Hughes | | |
| 2005/0229467 | A1 | 10/2005 | Sohn | | |
| 2014/0090520 | A1 * | 4/2014 | Lee | B25G 1/00 | 81/177.1 |

* cited by examiner

*Primary Examiner* — Bret Hayes
(74) *Attorney, Agent, or Firm* — Senniger Powers LLP

(57) ABSTRACT

A handle for manipulating a firearm rod, such as a firearm cleaning rod, and methods of using same. The handle is selectively movable along the length of the rod to desired positions along the length of the rod. The handle can be releasably secured to the rod at the desired positions. When the handle is releasably secured to the rod, the rod can rotate with respect to a body of the handle about the longitudinal axis of the rod.

23 Claims, 9 Drawing Sheets

HANDLE FOR MANIPULATING FIREARM ROD

CROSS-REFERENCE TO RELATED APPLICATION

This application claims priority to U.S. Provisional Patent Application No. 62/103,441, filed Jan. 14, 2015, which is hereby incorporated by reference in its entirety.

FIELD

The present disclosure generally relates to firearm rods, and more particularly to a handle for manipulating firearm rods.

BACKGROUND

Various types of firearm rods are known. One type of firearm rod is a cleaning rod used for cleaning a barrel of a firearm. A cleaning rod may be used to push and/or pull cleaning accessories such as brushes, jags, loops, and other tools (e.g., with solvent saturated and/or dry cleaning patches) along a firearm barrel for cleaning the barrel. Another type of firearm rod is a ram rod used for pushing a projectile down a firearm barrel and/or moving cleaning accessories in the barrel. Although existing firearm rods facilitate firearm cleaning and loading, additional improvements are needed.

SUMMARY

In one aspect, the present invention is directed to a handle for use with a firearm rod. The firearm rod includes opposite front and rear ends and a length extending between the front and rear ends. The handle includes a body and a releasable securing device. The body includes a front end, a rear end, and a firearm rod passage sized and shaped to receive the firearm rod. The firearm rod passage has an open front end, an open rear end, and a passage axis extending therebetween along which the firearm rod extends when received in the firearm rod passage. The releasable securing device is supported by the body for releasably securing the body to the firearm rod when the firearm rod is received in the firearm rod passage. The releasable securing device includes an actuator. The actuator has a securing position in which the releasable securing device releasably secures the body on the firearm rod at a selected position along the length of the firearm rod. The actuator has a non-securing position in which the releasable securing device permits movement of the body with respect to the firearm rod along the length of the firearm rod when the firearm rod is received in the firearm rod passage.

In another aspect, the present invention is directed to a method of pushing a firearm rod down a barrel of a firearm. The method includes moving a handle on a firearm rod from a first position along the length of the firearm rod to a second position along the length of the firearm rod. The firearm rod extends through a firearm rod passage in the handle in the first and second positions. The method includes releasably securing the handle on the firearm rod at the second position, and pushing a front end of the firearm rod in the barrel using the handle secured at the second position.

Other objects and features of the present invention will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
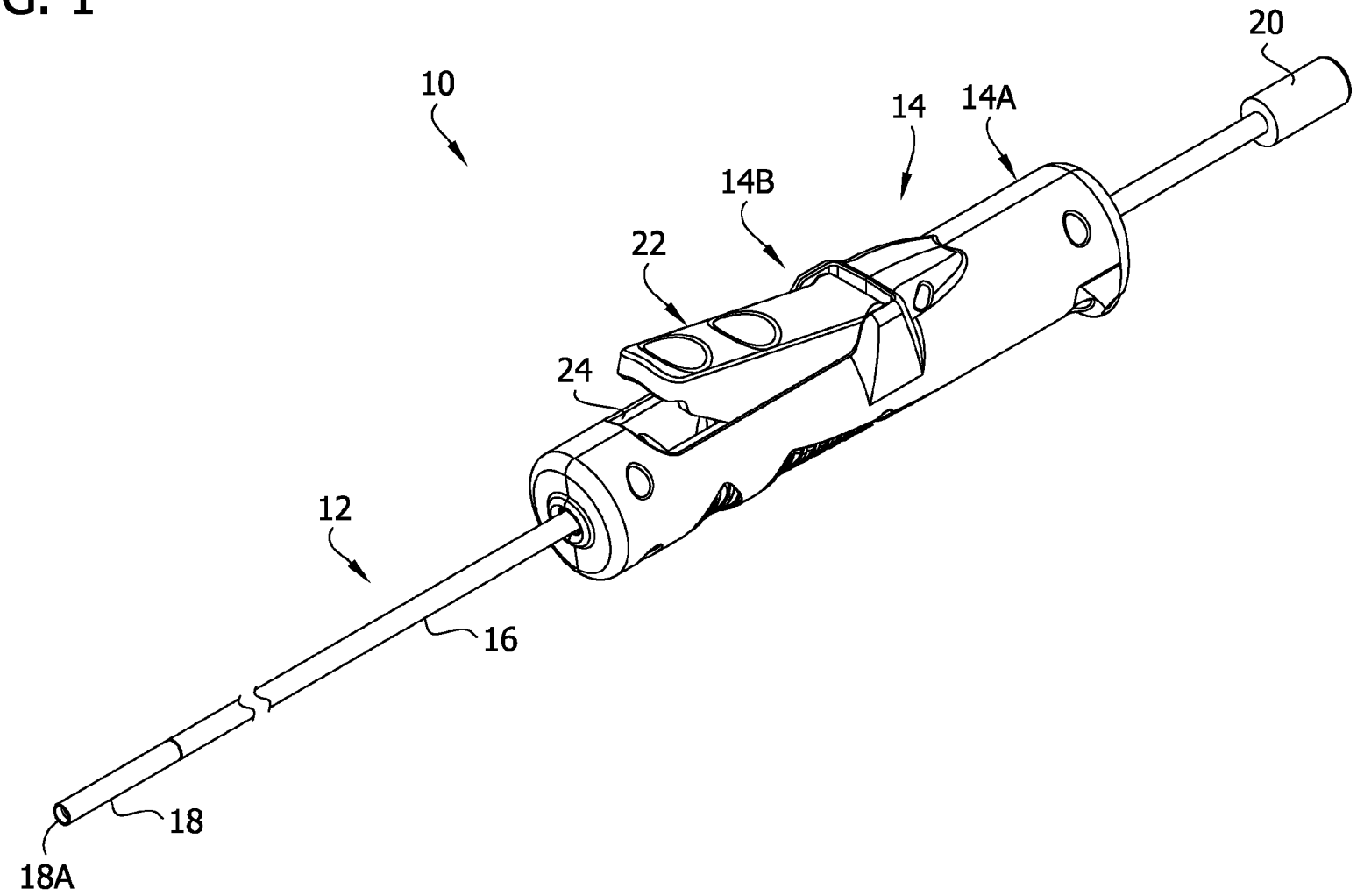
FIG. 1 is a front perspective of a cleaning rod assembly of the present invention including a handle and a cleaning rod, an intermediate portion of the cleaning rod being broken away.
Figure 2:
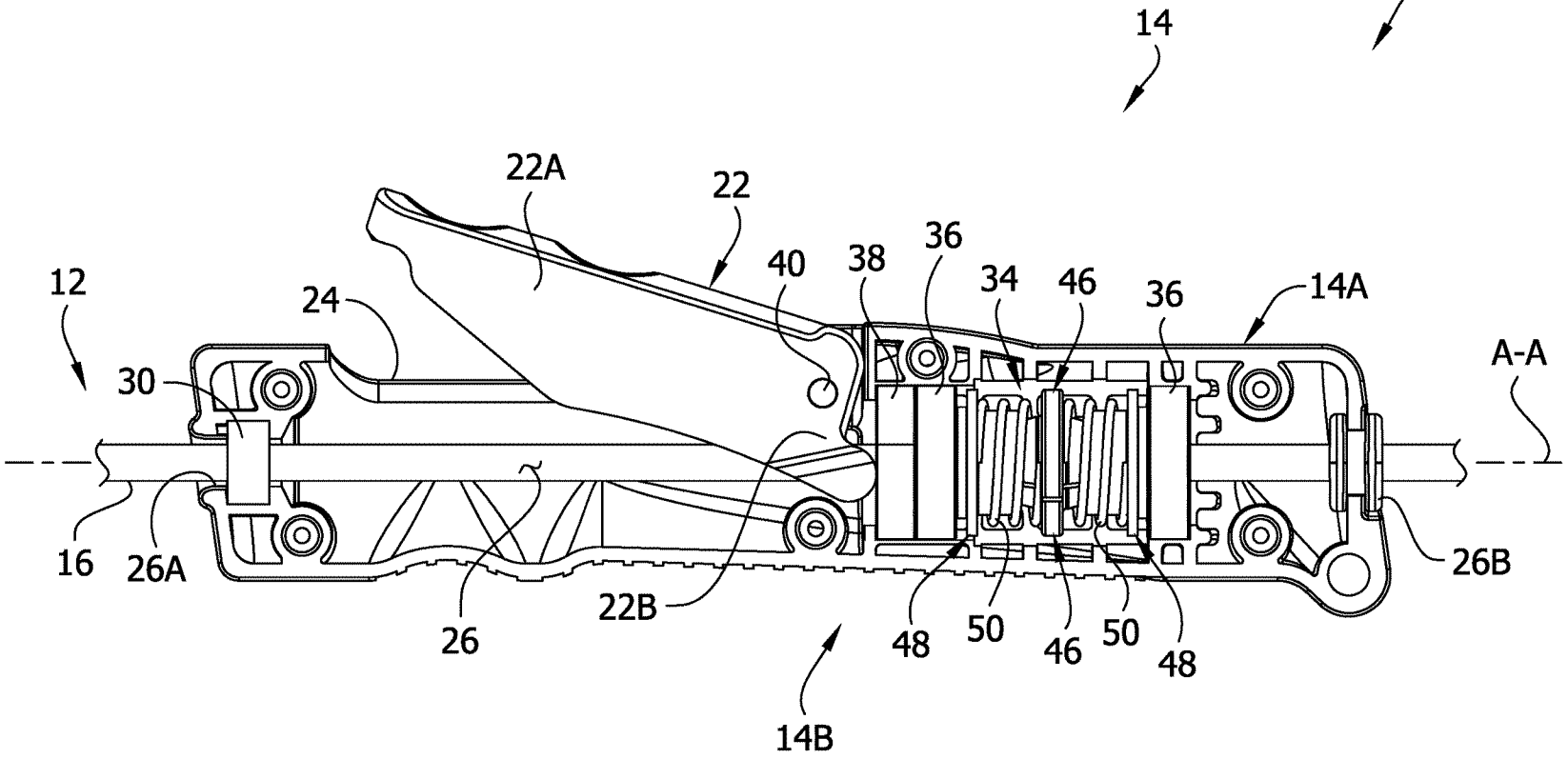
FIG. 2 is an enlarged side elevation of the handle and a portion of the cleaning rod, a housing portion of the handle being removed to expose internal components, the handle being shown in a non-secured position on the cleaning rod.

Referring to FIGS. 1 and 2, a cleaning rod assembly of the present invention is designated generally by the reference number 10. The cleaning rod assembly can be used for various firearm cleaning tasks, such as cleaning a barrel of a firearm. In general, the cleaning rod assembly 10 includes a cleaning rod 12 (broadly "firearm rod") and a handle 14. As will become apparent, the cleaning rod assembly 10 permits easy and rapid adjustment of a position of the handle 14 on the cleaning rod 12. This makes the cleaning rod assembly 10 more versatile and functional than conventional cleaning rod assemblies.

Referring to FIG. 1, the cleaning rod 12 includes a front end, a rear end, and a length extending between the front and rear ends. The cleaning rod 12 includes a generally cylindrical shaft 16 having a mount 18 at the front end, and a stop 20 at the rear end. The shaft 16 can be made of carbon fiber, metal, plastic, and/or another suitable material. The mount 18 includes a receptacle 18A constructed for threaded connection with a firearm cleaning element. For example without limitation, the receptacle may be a bore 18A including an internal thread of 8-32 size. Various firearm cleaning elements, such as brushes, jags, loops, etc., can be connected to the mount 18 for performing various firearm cleaning tasks. Other types of mounts and firearm cleaning elements can be used without departing from the scope of the present invention. For example, the mount 18 may comprise an externally threaded shaft instead of an internally threaded bore. In the illustrated embodiment, the stop 20 at the rear end of the cleaning rod 12 is mounted on the rear of the shaft 16. The stop 20 limits rearward movement of the handle 14 on the cleaning rod 12, as will become apparent. In FIG. 1, the cleaning rod 12 is shown as having an indefinite length.

It will be understood that cleaning rods having various lengths can be used without departing from the scope of the present invention. For example, the cleaning rod 12 may be about 10, 15, 20, 26, 36, 40, 44, 50, 62 or more inches long.

The handle 14 includes a housing 14A and a releasable securing device 14B supported by the housing. As will be explained in further detail below, using an actuator 22 of the releasable securing device 14B, the handle 14 can be secured on the cleaning rod 12 at selected positions along the length of the cleaning rod. Accordingly, a user can grip the cleaning rod 12 with the handle 14 at different positions along the length of the cleaning rod to change the effective length of the cleaning rod, i.e., the length of the cleaning rod extending from the handle to the mount 18. Moreover, when the handle 14 is secured on the cleaning rod 12, the handle permits the cleaning rod to rotate with respect to the handle. Accordingly, the cleaning rod 12 can rotate in response to, for example, a firearm cleaning element on the mount 18 tracking rifling in a barrel of a firearm as the cleaning element is pushed down the barrel.

In the illustrated embodiment, the housing 14A has an interior that houses several components of the releasable securing device 14B. The housing 14A (broadly "a body") is formed of two molded plastic shell pieces secured to each other. The housing 14A is generally cylindrical and has opposite front and rear ends. A bottom side of the housing includes contours formed to facilitate gripping of the housing by fingers of a user. A top side of the housing includes an opening 24 out of which the actuator 22 extends. The housing 14A has an interior defining a cleaning rod passage 26 sized and shaped for receiving the shaft of the cleaning rod. The passage 26 includes a front opening 26A adjacent the front of the housing and a rear opening 26B adjacent the rear of the housing. The passage 26 includes a passage axis A-A along which the cleaning rod 12 extends when received in the passage. The cleaning rod 12 extends forward out of the front opening 26A of the passage and rearward out of the rear opening 26B of the passage when the cleaning rod is received in the passage 26.

Figure 5:
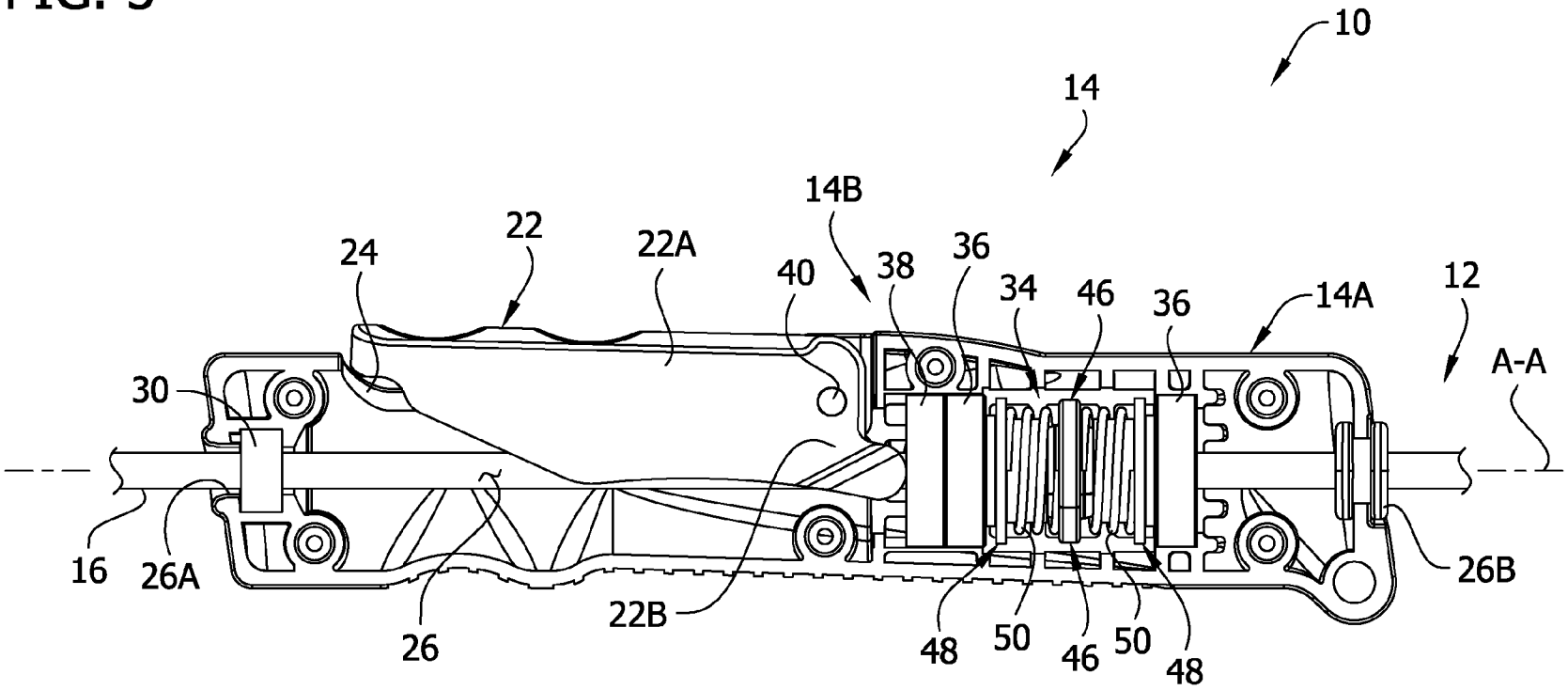
FIG. 5 is a side elevation similar to FIG. 2 but showing the handle in a secured position on the cleaning rod.
Figure 6:
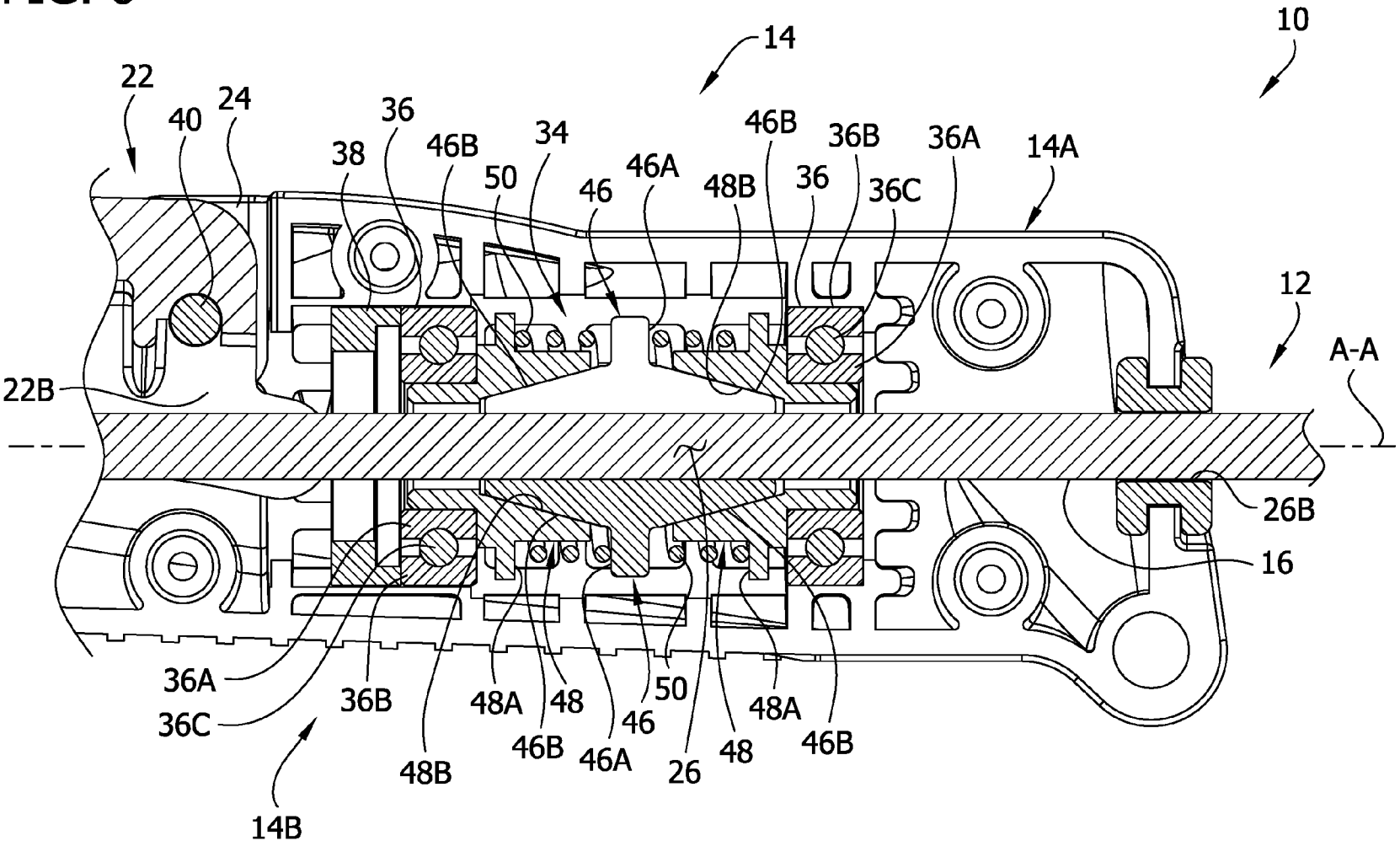
FIG. 6 is an enlarged fragmentary section of the handle and cleaning rod in an enlarged scale with the handle shown in the secured position.

As shown in FIGS. 2 and 5, the handle 14 includes a cleaning rod wiper 30 at the front opening of the housing. The wiper 30 is constructed to wipe the cleaning rod shaft 16 as the handle 14 is moved along the length of the cleaning rod 12. The wiper 30 is positioned adjacent the front of the housing, forward from the releasable securing device 14B, and rearward from the mount 18 of the cleaning rod 12. Desirably, the wiper 30 is flexible and/or absorbent for conforming to the outer surface of the shaft 16 and for wiping and absorbing solvent, oil, debris, etc. from the outer surface of the shaft. The wiper 30 is constructed to wipe the entire outer circumference of the shaft. The wiper 30 defines an opening having a diameter about the same as or slightly less than the diameter of the cleaning rod shaft so the wiper engages the shaft around the circumference of the shaft. In the illustrated embodiment, the wiper 30 is an annular bushing of felt. It will be appreciated that the wiper assists in preventing solvent, oil, debris, etc. from entering the housing and from reaching the releasable securing device 14B inside the housing, where it may adversely affect the performance of the releasable securing device. Other types of wipers can be used without departing from the scope of the present invention.

Referring to FIGS. 2-6, the releasable securing device 14B will be described in more detail. The releasable securing device 14B is configured for releasably securing the housing 14A on the cleaning rod 12. The releasable securing device 14B is supported by the housing 14A and includes the actuator 22, a clamp mechanism 34, a pair of bearings 36, and a bushing 38. The clamp mechanism 34, bearings 36, and bushing 38 are received in a generally cylindrical cavity of the housing 14A, between the front and rear ends of the housing. The cleaning rod passage 26 extends through openings in the clamp mechanism 34, bearings 36, and bushing 38. The actuator 22 is pivotally mounted on the housing 14A and is operatively connected to the clamp mechanism 34 via the bushing 38 and forward bearing 36 to cause the clamp mechanism to lock the handle 14 in position on the cleaning rod 12 in response to movement of the actuator. The actuator 22 has a non-securing position (e.g., see FIGS. 2 and 3) in which the releasable securing device 14B permits movement of the housing 14A with respect to the cleaning rod 12 along the length of the cleaning rod. In this position, the cleaning rod can be slid forward or rearward through the cleaning rod passage 26. The actuator 22 also has a securing position (e.g., see FIGS. 5 and 6) in which the releasable securing device 14B releasably secures the housing 14A on the cleaning rod 12 at a selected position along the length of the cleaning rod, preventing sliding movement of the cleaning rod through the passage 26. Accordingly, using the actuator 22, a user can selectively secure the handle 14 on the cleaning rod 12 at a desired position along the length of the cleaning rod.

As shown in FIG. 2, the actuator 22 includes a first lever 22A positioned for actuation by the user, and a second lever 22B movable conjointly with the first lever. The actuator 22 is pivotally mounted on the housing 14A by a pin connection 40 defining a pivot axis of the actuator. The first lever 22A is longer with respect to the pin connection 40 than the second lever 22B. The first lever 22A extends from the pin connection 40 forward and laterally with respect to the housing out of the opening 24 in the top side of the housing 14A. The first lever 22A includes a generally upward facing push surface constructed for a user to press to move the actuator toward the securing position. It will be appreciated that the orientation and position of the first lever 22A with respect to the housing 14A facilitates engagement of the first lever by a thumb of a user. In particular, for example, a user can wrap their index, middle, and ring fingers around the bottom side of the housing 14A, and rest their thumb on the first lever 22A pointing forward generally toward the front end of the cleaning rod 12. With this grip, the user can move the actuator 22 to the securing position and push/pull the cleaning rod assembly 10 with the same grip on the handle. The second lever 22B includes first and second arms positioned on opposite sides of the passage axis A-A for transmitting force from the actuator 22 to the clamp mechanism 34. The arms of the second lever 22B are spaced from each other for receiving the cleaning rod shaft 16 therebetween, and engage respective opposite sides of a forward face of the bushing 38. The forward face of the bushing 38 has an annular actuator engagement surface sized for engagement with the arms of the second lever 22B. A rear face of the bushing 38 has an annular bearing engagement surface, which will be described in further detail below. The bushing 38 includes an opening through which the cleaning rod shaft 16 passes. The bushing 38 acts as a force distributing member for transmitting force from the actuator 22 axially with respect to the passage axis A-A of the cleaning rod passage 26 to the clamp mechanism 34 for clamping on the cleaning rod shaft 16, as explained in further detail below.

Figure 3:
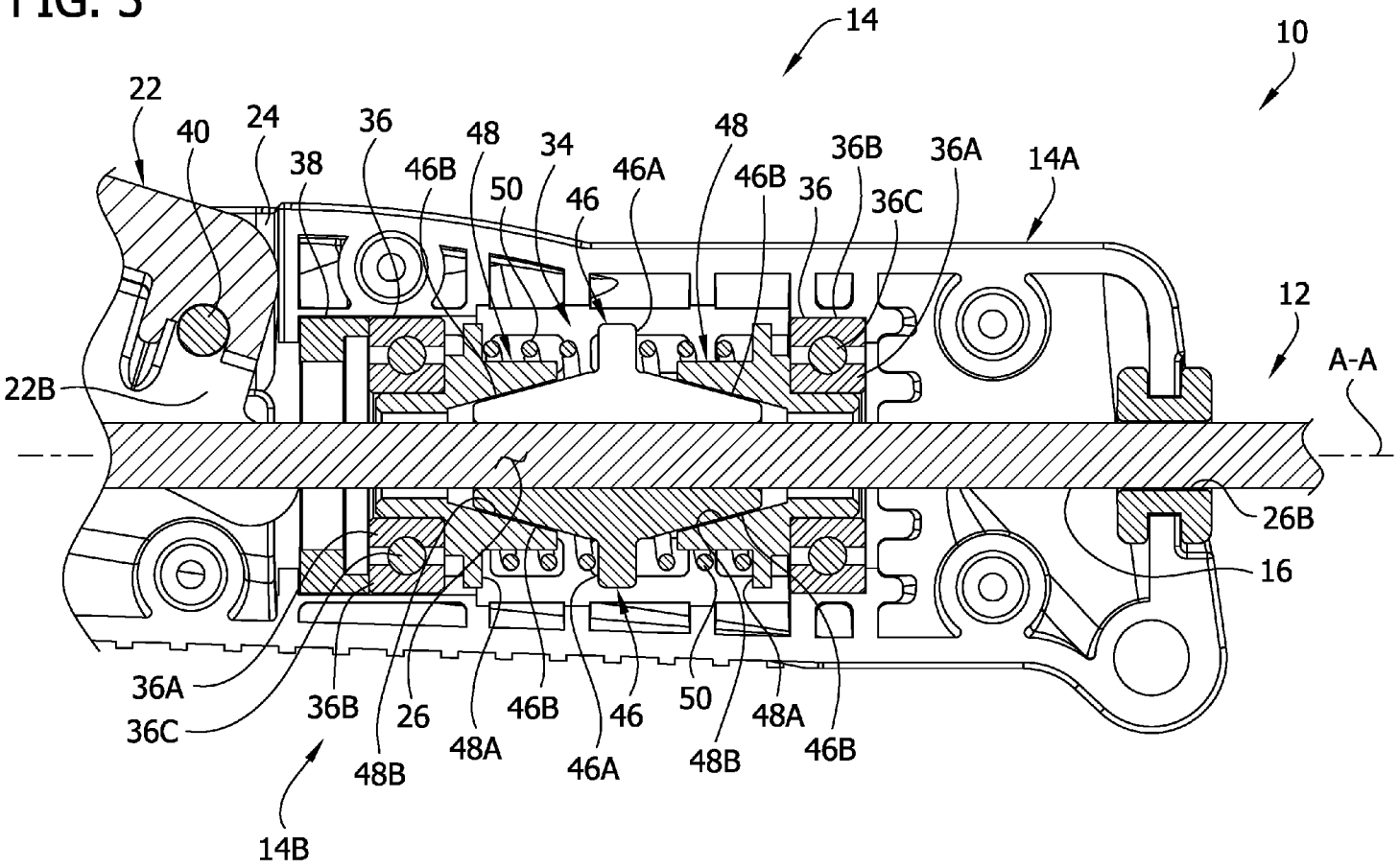
FIG. 3 is an enlarged fragmentary section of the handle and cleaning rod in an enlarged scale with the handle shown in the non-secured position.
Figure 4:
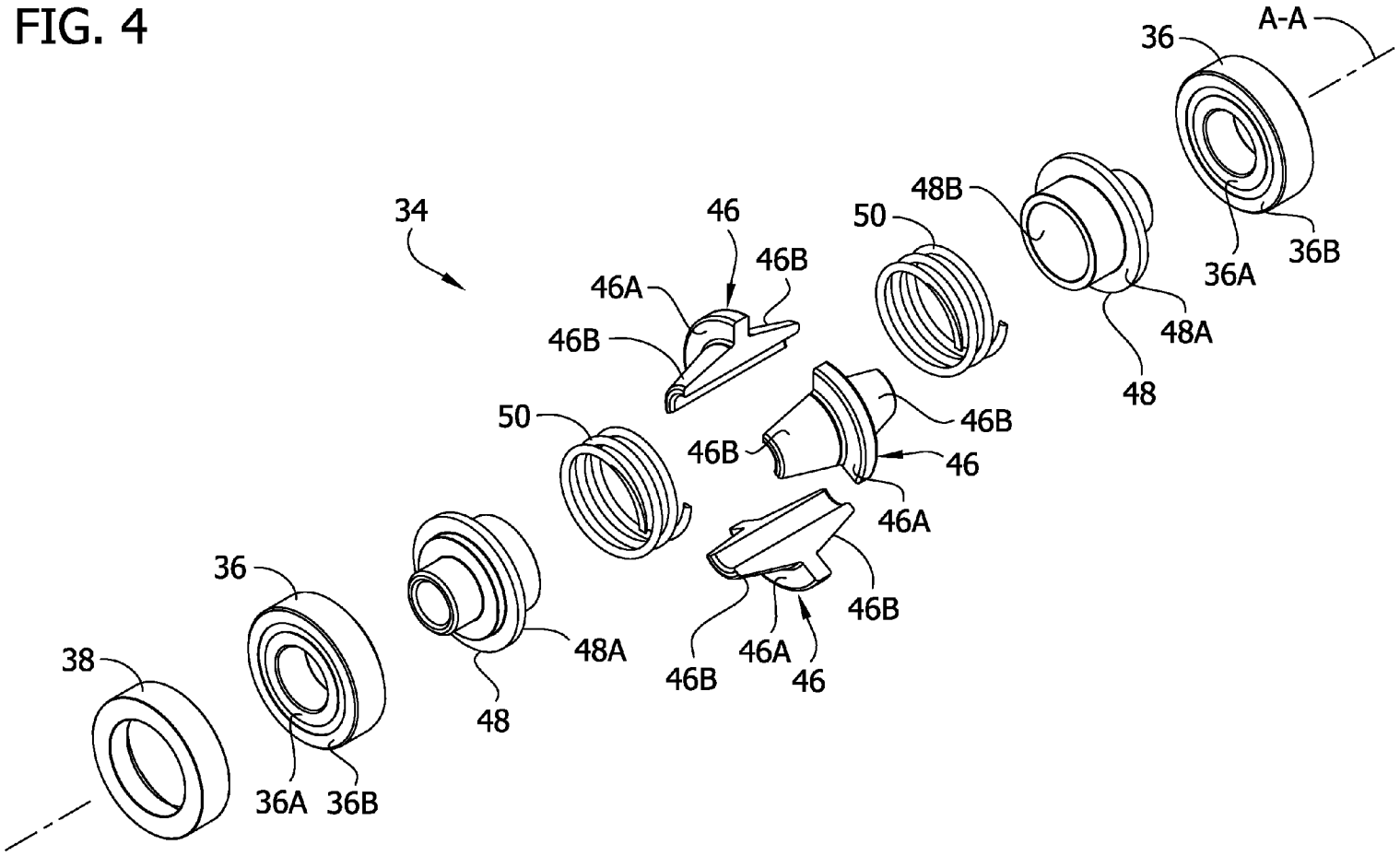
FIG. 4 is an exploded perspective of components of a releasable securing device of the handle.

As shown in FIGS. 3 and 4, the clamp mechanism 34 includes multiple cleaning rod engagement members 46 constructed for securely engaging the cleaning rod shaft 16 and a pair of cams 48 constructed for moving the cleaning rod engagement members into securing engagement with the shaft. In the illustrated embodiment, there are three cleaning rod engagement members 46 (see FIG. 4), which may also be referred to as clamp shoes. The cleaning rod engagement members 46 are provided at different angular positions with respect to the passage axis A-A and together form a segmented sleeve having a cleaning rod shaft receiving bore of adjustable diameter. The cams 48 are provided in the form of forward and rear sleeves positioned adjacent respective opposite forward and rear ends of the cleaning rod engagement members 46. In the illustrated embodiment, the cams 48 are single-piece sleeves, but the cams can be formed of multiple pieces without departing from the scope of the present invention. The cams 48 overlie portions of the cleaning rod engagement members 46. The forward cam 48 is movable rearward and forward along the cleaning rod passage 26. The rear cam 48 is fixed in position (immovable) with respect to the housing 14A. The clamp mechanism 34 includes two compression coil springs 50 (broadly "biasing members"), which bias the cams 48 in respective opposite directions away from each other. As shown in FIG. 3, the springs 50 are received over respective ends of the cleaning rod engagement members 46 and over respective ends of the cams 48, and the ends of the springs bear against respective opposite sides of flanges 46A extending radially outward on the cleaning rod engagement members 46 and flanges 48A extending radially outward on respective cams 48. The arrangement is such that the springs 50 bias the actuator 22 toward its non-securing position, in which the cleaning rod engagement members 46 are not in clamping engagement with the cleaning rod shaft 16, so the handle 14 can be moved along the length of the cleaning rod 12.

A user can secure the handle 14 in position on the cleaning rod 12 by pressing the first lever 22A of the actuator 22. As shown by comparison of FIGS. 3 and 6, this causes the arms of the second lever 22B to push the bushing 38, forward bearing 36, and forward cam 48 rearward such that the forward cam slides rearward over the cleaning rod engagement members 46 and causes the cleaning rod engagement members to move rearward farther into the rear cam 48. The arrangement is such that rearward movement of the forward cam 48 and the cleaning rod engagement members 46 against the bias of the springs 50 causes the forward and rear cams to move the cleaning rod engagement members radially inward into securing engagement with the cleaning rod shaft 16 for clamping on the shaft. The cams 48 and cleaning rod engagement members 46 have corresponding tapered surfaces to effect the movement of the cleaning rod engagement members into releasable clamping engagement with the cleaning rod shaft 16. The cams 48 include respective passages defined by conical cam surfaces 48B. The conical passages taper from a relatively large diameter at a first end of the bore to a relatively small diameter at a second opposite end of the bore. The cams 48 are arranged in opposite orientations such that the relatively large diameter ends of the passages face each other and are received over the opposite forward and rear ends of the cleaning rod engagement members 46. The cleaning rod engagement members 46 include respective conical segment cam engagement surfaces 46B constructed to interface with the cam surfaces of the cams. Each cleaning rod engagement member 46 includes a forward cam engagement surface 46B positioned for engagement by the cam surface 48B of the front cam 48 and a rear cam engagement surface 46B positioned for engagement by the cam surface 48B of the rear cam 48. The front cam engagement surfaces 46B together form a segmented truncated conical surface facing forward for engagement with the conical bore of the front cam 48, and the rear cam engagement surfaces 46B together form a segmented truncated conical surface facing rearward for engagement with the conical bore of the rear cam 48. The cam surfaces 48B and cam engagement surfaces 46B taper with respect to the passage axis A-A at corresponding angles. For example without limitation, the cam surfaces 48B and cam engagement surfaces 46B may taper at an angle between about 8 degrees and about 22 degrees with respect to the passage axis, more preferably at an angle between about 12 degrees and about 18 degrees with respect to the passage axis, and even more preferably at an angle of about 15 degrees with respect to the passage axis. Desirably, the degree of taper is selected to permit a reasonable amount of pressure on the actuator 22 to create a significant clamping force on the cleaning rod shaft 16 yet also to prevent "taper lock" or frictional lock of the cams 48 on the cleaning rod engagement members 46 preventing the springs 50 from moving the cams back to their non-securing positions when the actuator is released. It has been found that a taper angle of about 15 degrees permits a user with ordinary strength to impart a clamping force of about 50 pounds on the cleaning rod shaft 16 and not result in taper lock of the cams 48 on the cleaning rod engagement members 46.

When the releasable securing device 14B is in the securing position, the cleaning rod 12 is permitted by the bearings 36 to rotate with respect to the housing 14A about the cleaning rod passage axis A-A. The bearings 36 include inner and outer races 36A, 36B, and the cams 48 are seated in openings in the respective inner races 36A. Desirably, one or more bearing elements 36C (e.g., balls) are provided in an annular space defined between the inner and outer races 36A, 36B to permit rotation of the inner race with respect to the outer race. The arrangement is such that the bearings 36 support the clamp mechanism 34, including the cams 48, cleaning rod engagement members 46, and springs 50, on the housing 14A of the handle 14. When the releasable securing device 14B is in the securing position, the inner races 36A, cams 48, cleaning rod engagement members 46, and springs 50 remain in fixed position with respect to the cleaning rod shaft 16, and they are permitted to rotate about the cleaning rod passage axis A-A with respect to the housing 14A, outer races 36B, bushing 38, and actuator 22. Because the annular bearing engagement surface on the rear face of the bushing 38 is constructed to engage the forward bearing 36 on the outer race 36B and not on the inner race 36A, the inner race is not rotationally restricted by friction against the bushing. Accordingly, when the releasable securing device 14B is in the securing position and a cleaning element on the front end of the cleaning rod 12 is pushed down a barrel of a firearm, the user can hold the handle housing 14A in a consistent orientation while the cleaning rod shaft 16 rotates with respect to the housing, permitting the a cleaning element to track rifling on the inside of the barrel.

When the actuator 22 is released by the user, the springs 50 move the actuator to its non-securing position by moving the cams 48 in opposite directions to the positions shown in FIG. 3. Accordingly, the cams 48 release the cleaning rod engagement members 46 from clamping engagement with the cleaning rod shaft 16. The handle 14 can then be moved to a different selected position along the length of the cleaning rod 12, where the actuator 22 can again be used to secure the handle in position on the cleaning rod.

It will be understood that the handle 14 can be adjusted to accommodate cleaning rod shafts of various diameters. For example, one or more components of the releasable securing device, such as the actuator 22, bushing 38, bearings 36, cams 48, and/or cleaning rod engagement members 46 can be interchangeable with similar components sized differently for accommodating a cleaning rod having a larger or smaller diameter shaft. In one example, the entire clamp mechanism 34 can be removed from the handle and replaced with a clamp mechanism constructed for use with a shaft having a different diameter. Moreover, other components, such as one or more bushings or shims can be added to the handle for adjusting it for use with a shaft having a different diameter.

Figure 7:
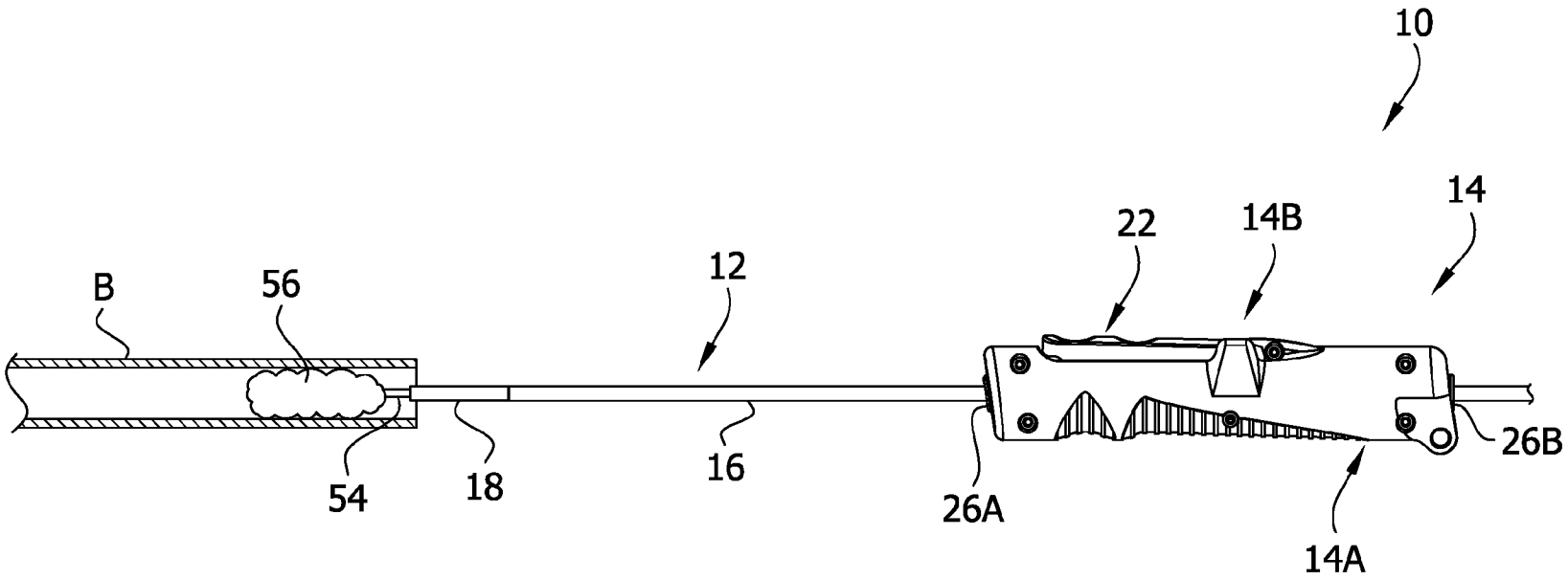
FIG. 7 is a side elevation of the cleaning rod assembly in use pushing a cleaning patch in a barrel of a firearm.
Figure 8:
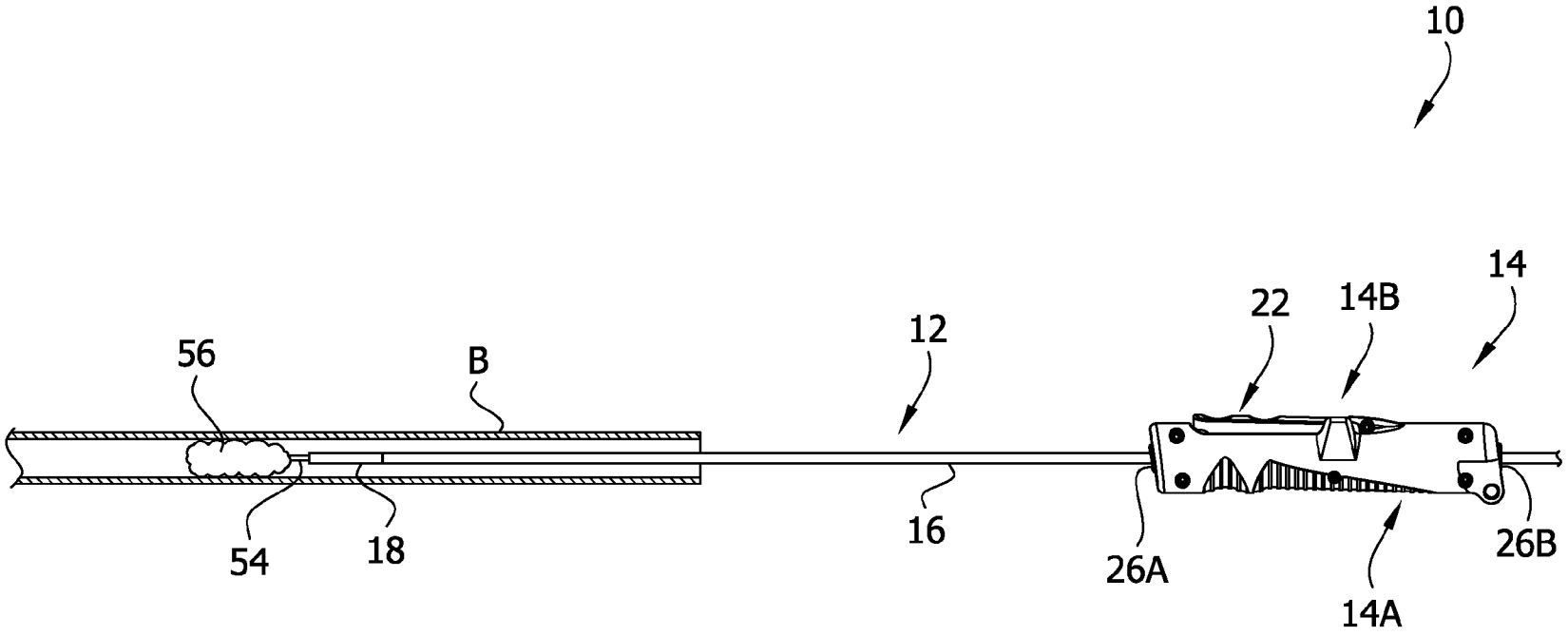
FIG. 8 is a view similar to FIG. 7 but showing the cleaning patch positioned farther in the barrel of the firearm and the handle moved to a different position along the length of the cleaning rod.

A method of using the cleaning rod assembly 10 is illustrated with reference to FIGS. 7 and 8. In FIG. 7, the cleaning rod assembly 10 is shown having a cleaning element 54 (e.g., jag) mounted on the mount 18, and a cleaning patch or cloth 56 mounted on the cleaning element and received in an open end of a firearm barrel B. The handle 14 is located at an intermediate position along the length of the cleaning rod shaft 16, with the actuator 22 in the securing position. A user may choose this "starting position" of the handle 14 on the cleaning rod shaft 16 to decrease the length of the cleaning rod shaft between the handle and the cleaning element 54 so that pushing of the cleaning rod 12 has less tendency to flex the cleaning rod shaft, as compared to pushing from the rear end of the cleaning rod. As the user pushes the cleaning element 54 into the barrel B the cleaning rod 12 may freely rotate in the handle 14 about the passage axis A-A. As shown in FIG. 8, after the handle 14 is moved relatively closely to the open end of the barrel B to push the cleaning element 54 into the barrel, the handle can be repositioned and releasably secured on the cleaning rod 12 farther back on the shaft 16 to permit the user to push another portion of the shaft into the barrel using the handle. This process can be repeated as many times as necessary to advance the cleaning element as far as desired into the barrel. And the process can be reversed if desired for removing the cleaning rod 12 from the barrel B.

In view of the foregoing, it will be appreciated that cleaning rod assemblies according to the present invention are more versatile and functional than conventional cleaning rods. The handle 14 permits the user to grip the cleaning rod 12 essentially anywhere along the length of the shaft 16. The user is not limited to using the handle at the far rear end of the cleaning rod 12, as in conventional configurations. The effective length of the cleaning rod 12 can be changed by moving the handle 14 on the shaft. A relatively long shaft 16 can be pushed in increments into a barrel or pushed into a shorter length barrel (e.g., a handgun barrel) from a more appropriate intermediate position on the length of the cleaning rod 12. The handle 14 provides better control of the cleaning rod 12 and can reduce the possibility that the cleaning rod will bow or flex along its length when forced down a firearm barrel.

It will be appreciated that the embodiment shown and described herein is provided by way of example and not limitation. Other configurations and constructions can be used without departing from the scope of the present invention. For example, actuators having other constructions and/or orientations can be used. A lock may be provided for locking the actuator in its securing position, such as explained below with reference to FIG. 9. The actuator may be biased toward the securing position instead of toward the non-securing position, in which case pressing of the actuator by a user could move the actuator to the non-securing position. Moreover, the bushing, bearings, and/or components of the clamping device, can have other constructions or orientations, or be omitted, without departing from the scope of the present invention. Moreover, other numbers of cleaning rod engagement members, cams, and/or bearings may be used without departing from the scope of the present invention.

Figure 9:
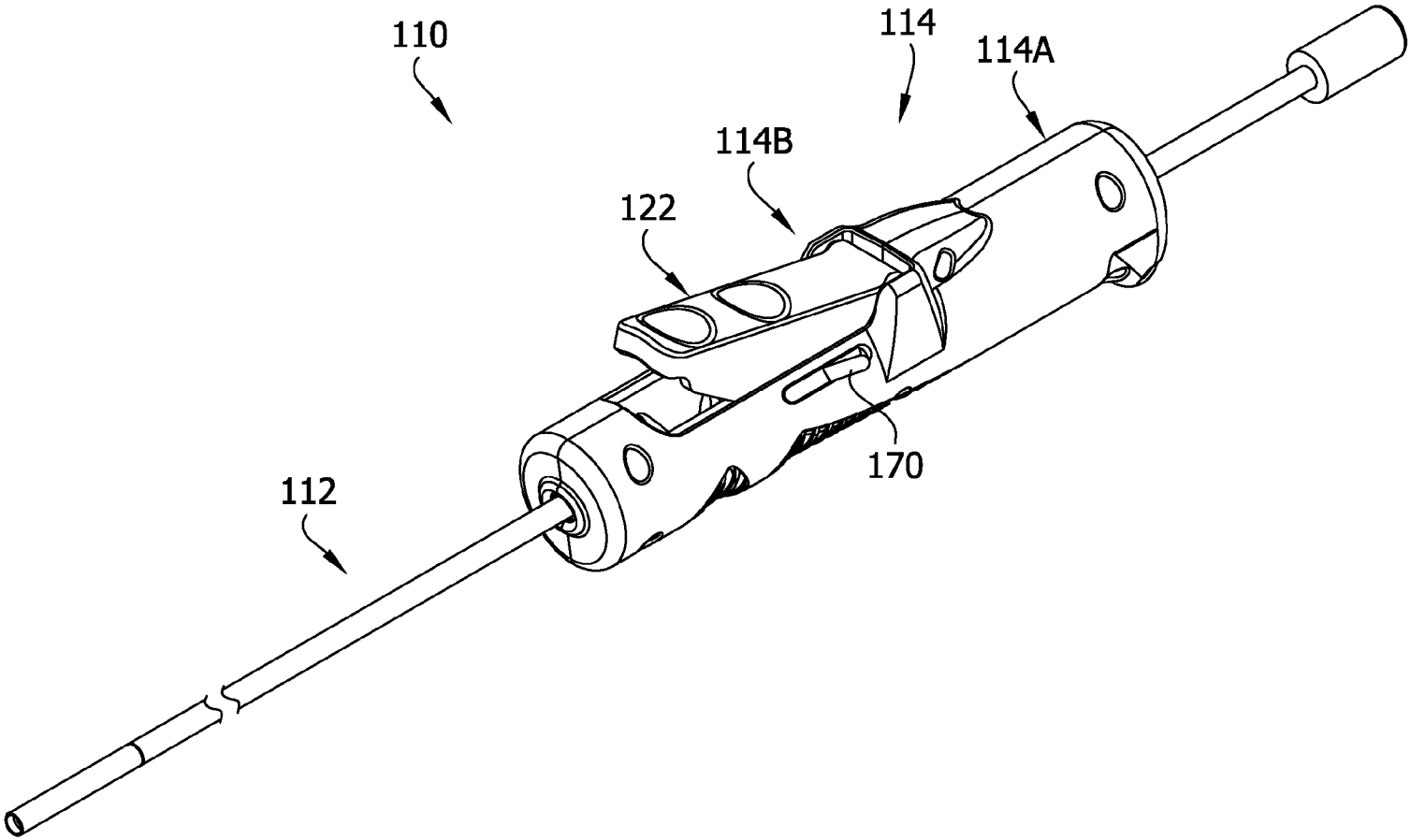
FIG. 9 is a front perspective of a second embodiment of a cleaning rod assembly of the present invention including a handle and a cleaning rod, an intermediate portion of the cleaning rod being broken away.

Referring to FIG. 9, a cleaning rod assembly according to a second embodiment of the present invention is designated generally by the reference number 110. The cleaning rod assembly is essentially the same as the cleaning rod assembly 10, except for the features described hereafter. Like parts are indicated with like reference numbers, plus 100. In this embodiment, a lock 170 is provided for selectively locking the handle 114 in its securing position on the cleaning rod 112. In the illustrated embodiment, the lock 170 is supported on the housing 114A and has locking and non-locking positions relative to the releasable securing device 114B. The lock 170 is shown as including a rocker switch for moving the lock between the locking and non-locking positions, but other types of locks can be used without departing from the scope of the present invention. In the non-locking position, the lock 170 permits the actuator to move between its securing and non-securing positions. In the locking position, the lock 170 maintains the actuator 122 in the securing position. For example, the lock 170 may frictionally engage the actuator, matingly engage the actuator, and/or block a travel path of the actuator to the non-securing position. For example, when the user presses the actuator 122 to move it to the securing position, the lock 170 can be moved to its locking position to maintain the actuator in the securing position without the user applying pressure to the actuator. The user can use the cleaning rod assembly 110 with the handle 114 in the secured position on the cleaning rod 112 without needing to maintain pressure on the actuator 122. When the user is ready to move the handle 114 to a different position on the cleaning rod 112, the user can move the lock to the non-locking position, which permits the actuator to move to its non-securing position. It will be appreciated other types of locks can be used without departing from the scope of the present invention. For example, the lock 170 can lock the handle 114A in position on the cleaning rod 112 by engagement with and/or blocking of a component of the releasable securing device 114B other than the actuator 122.

It will be understood that although the handles disclosed herein are shown as being used with cleaning rods, the handles could be used with other firearm rods without departing from the scope of the present invention. For example, it will be appreciated that a ram rod assembly could include a ram rod and a handle having essentially the same construction as disclosed herein. The handle would function essentially the same as the handles disclosed herein, and the ram rod could be used for various functions, including pushing a projectile down a barrel of a firearm and/or cleaning a barrel of a firearm.

Having described the invention in detail, it will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A handle for use with a firearm rod, the firearm rod including opposite front and rear ends and a length extending between the front and rear ends, the handle comprising:

a body including a front end, a rear end, and a firearm rod passage sized and shaped to receive the firearm rod, the firearm rod passage having an open front end, an open rear end, and a passage axis extending therebetween along which the firearm rod extends when received in the firearm rod passage, and a releasable securing device supported by the body for releasably securing the body on the firearm rod when the firearm rod is received in the firearm rod passage, the releasable securing device including an actuator having a securing position in which the releasable securing device releasably secures the body to the firearm rod, and the actuator having a non-securing position in which the releasable securing device permits movement of the body with respect to the firearm rod along the length of the firearm rod when the firearm rod is received in the firearm rod passage;

wherein the actuator is supported by the body to have a travel path with respect to the body between the securing position and the non-securing position, the actuator being configured to move along the travel path from one of the securing and non-securing positions to the other of the securing and non-securing positions in response to a pressing force applied by a user to the actuator in a direction of travel along the travel path, the releasable securing mechanism being configured to secure to the firearm rod at an infinite number of locations along the length of the firearm rod when the actuator is in the securing position for releasably securing the body on the firearm rod.

2. A handle as set forth in claim 1 wherein the releasable securing device includes a clamp mechanism, the clamp mechanism including at least two firearm rod engagement members having respective securing engagement positions when the actuator is in the securing position for clamping the firearm rod, the at least two firearm rod engagement members being separate from and movable with respect to the actuator and the body.

3. A handle as set forth in claim 2 wherein the clamp mechanism includes at least one cam having a cam surface;

at least one of the firearm rod engagement members includes a cam engagement surface constructed for engaging the cam surface; and the cam surface is configured for moving the at least one firearm rod engagement member to the securing engagement position by engagement with the cam engagement surface responsive to movement of the actuator toward the securing position.

4. A handle as set forth in claim 3 wherein the at least one cam comprises a first cam and a second cam, the first and second cams being positioned for engaging respective opposite end portions of the at least one firearm rod engagement member.

5. A handle as set forth in claim 3 wherein the cam surface is tapered, and the cam engagement surface of the at least one firearm rod engagement member is tapered corresponding to the taper of the cam surface.

6. A handle as set forth in claim 1 wherein the releasable securing device includes a first tapered surface and a second tapered surface corresponding to the first tapered surface, the first tapered surface being slidable on the second tapered surface by movement of the actuator toward the securing position for releasably securing the body at a selected position along the length of the firearm rod.

7. A handle as set forth in claim 6 wherein the corresponding tapered surfaces taper at an angle between about 8 degrees and about 22 degrees with respect to the passage axis.

8. A handle as set forth in claim 1 further comprising a firearm rod wiper supported by the body, the firearm rod wiper being constructed to wipe an exterior of the firearm rod as the body is moved along the length of the firearm rod.

9. A handle as set forth in claim 1 in combination with the firearm rod, wherein the firearm rod includes a stop adjacent the rear end of the firearm rod for limiting movement of the handle rearward on the firearm rod.

10. A handle as set forth in claim 1 wherein the actuator is configured for pushing from the non-securing position to the securing position by said pressing force, the releasable securing mechanism being configured to apply a securing force to the firearm rod in response to said pressing force when the actuator is in the securing position, said securing force being greater than said pressing force.

11. A handle as set forth in claim 1 wherein the actuator includes a push surface pushable in the direction of travel along the travel path, the push surface being arranged for pushing a first distance from the non-securing position to the securing position, and wherein the releasable securing device includes at least one firearm rod engagement member operatively connected to the actuator, the firearm rod engagement member being in a non-clamping position for permitting movement of the body with respect to the firearm rod along the length of the firearm rod when the actuator is in the non-securing position, the firearm rod engagement member being in a clamping position for securing the base on the firearm rod when the actuator is in the securing position, the firearm rod engagement member being movable a second distance from the non-clamping position to the clamping position, the first distance being greater than the second distance.

12. A handle as set forth in claim 1 wherein the actuator is biased toward the non-securing position.

13. A handle for use with a firearm rod, the firearm rod including opposite front and rear ends and a length extending between the front and rear ends, the handle comprising:

a body including a front end, a rear end, and a firearm rod passage sized and shaped to receive the firearm rod, the firearm rod passage having an open front end, an open rear end, and a passage axis extending therebetween along which the firearm rod extends when received in the firearm rod passage, and a releasable securing device supported by the body for releasably securing the body on the firearm rod when the firearm rod is received in the firearm rod passage, the releasable securing device including an actuator having a securing position in which the releasable securing device releasably secures the body to the firearm rod at a selected position along the length of the firearm rod, and the actuator having a non-securing position in which the releasable securing device permits movement of the body with respect to the firearm rod along the length of the firearm rod when the firearm rod is received in the firearm rod passage, wherein the releasable securing device is configured to permit the firearm rod to rotate about the passage axis relative to the body when the actuator is in the securing position.

14. A handle as set forth in claim 13 wherein the releasable securing device includes at least one firearm rod engagement member movable to a securing engagement position with respect to the firearm rod passage for engaging the firearm rod for releasably securing the body at a selected position along the length of the firearm rod, and the releasable securing device includes at least one bearing supporting the at least one firearm rod engagement member permitting the firearm rod engagement member to rotate with respect to the body when the firearm rod engagement member is in securing engagement with the firearm rod.

15. A handle as set forth in claim 14 wherein the at least one bearing comprises a first bearing supporting a first portion of the firearm rod engagement member and a second bearing supporting a second portion of the firearm rod engagement member.

16. A handle as set forth in claim 15 wherein the first bearing is movable with respect to the body along the firearm rod passage by movement of the actuator.

17. A handle as set forth in claim 16 wherein the releasable securing device includes at least one cam supported by the first bearing, the at least one cam being constructed to move the firearm rod engagement member to the securing engagement position in response to movement of the actuator.

18. A handle for use with a firearm rod, the firearm rod including opposite front and rear ends and a length extending between the front and rear ends, the handle comprising:

a body including a front end, a rear end, and a firearm rod passage sized and shaped to receive the firearm rod, the firearm rod passage having an open front end, an open rear end, and a passage axis extending therebetween along which the firearm rod extends when received in the firearm rod passage, and a releasable securing device supported by the body for releasably securing the body on the firearm rod when the firearm rod is received in the firearm rod passage, the releasable securing device having a securing configuration in which the releasable securing device releasably secures the body to the firearm rod at a selected position along the length of the firearm rod, the releasable securing device having a non-securing configuration in which the releasable securing device permits movement of the body with respect to the firearm rod along the length of the firearm rod when the firearm rod is received in the firearm rod passage, the releasable securing device including a component rotatably mounted by a pin connection for changing direction of force transmitted through the releasable securing device.

19. A handle as set forth in claim 18 wherein said component includes a lever mounted by the pin connection.

20. A handle as set forth in claim 18 wherein the releasable securing device includes an actuator including a push surface, the actuator having a securing position in the securing configuration of the releasable securing device and having a non-securing position in the non-securing configuration of the releasable securing device, the actuator having a travel path between the securing position and the non-securing position, the push surface being arranged for pushing in a direction of travel along the travel path to move the actuator from one of the securing and non-securing positions to the other of the securing and non-securing positions.

21. A handle as set forth in claim 20 wherein the push surface is arranged for pushing in the direction of travel along the travel path to move the actuator from the non-securing position to the securing position.

22. A handle as set forth in claim 21 wherein the actuator is biased toward the non-securing position.

23. A handle as set forth in claim 20 wherein the actuator includes a lever mounted by the pin connection, the lever having the push surface.

* * * * *